United States Patent [19]

Menz et al.

[11] 4,282,814

[45] Aug. 11, 1981

[54] DUAL-END WARHEAD INITIATION SYSTEM

[75] Inventors: Fredric L. Menz; Gordon A. Greene, both of Ridgecrest, Calif.

[73] Assignee: The United States of America as represented by the Secretary of the Navy, Washington, D.C.

[21] Appl. No.: 535,068

[22] Filed: Dec. 20, 1974

[51] Int. Cl.[3] ..... F42B 13/02

[52] U.S. Cl. ..... 102/318; 102/499; 102/275 J

[58] Field of Search ..... 102/56, 67, DIG. 2, 102/56 R

[56] References Cited

U.S. PATENT DOCUMENTS

| | | | |
|---|---|---|---|
| 3,678,853 | 7/1972 | Kilmer | 102/27 |
| 3,853,059 | 12/1974 | Moe | 102/67 |
| 3,896,731 | 7/1975 | Kilmer | 102/DIG. 2 |

*Primary Examiner*—Peter A. Nelson

*Attorney, Agent, or Firm*—R. S. Sciascia; W. Thom Skeer; Roy Miller

[57] ABSTRACT

A detonation initiator for use in explosive warheads to cause dual-end initiation of the explosive within the warhead. An initiation transfer tube positioned interiorly and centrally within the warhead explosive contains a primary ignitor attached to a plurality of explosive trains leading to secondary ignitors. Booster plates positioned at either end of the explosive charge and adjacent the secondary ignitors detonate the explosive at either end causing the detonating front to travel toward the center of the explosive causing a great force to extend radially outward centrally from either end of the explosive. An initiation transfer tube positioned concentric with the explosive provides for an explosive output initiating from a single point at the center of the warhead to its ends without destroying or damaging the warhead.

4 Claims, 6 Drawing Figures

DUAL-END WARHEAD INITIATION SYSTEM

BACKGROUND OF THE INVENTION

The invention relates to a unique detonation initiator for providing substantially simultaneous initiation of opposite ends of an explosive charge.

It is important in many modern rockets or missile warheads to achieve a high energy directional detonation front so as to utilize the maximum destructive effect available from the amount of explosive carried by the warhead. Many prior missile and rocket warheads have attempted to control the direction of the detonation front by using a variety of techniques. In some cases, the warhead explosive is cast in various structural configurations to direct a detonation front in the desired direction. In others, the explosive is pressed and machined to obtain the desired structural shape.

Another technique in the prior art to direct an explosive blast is to either reinforce or weaken certain areas of the explosive casing to direct the blast in a desired direction or directions. These techniques have the effect of adding weight to the missile or rocket warhead and require necessarily complex molding or machining of the explosive.

The present invention overcomes the disadvantages of the prior art by providing a simple inexpensive dual-end initiation apparatus that can be used with conventionally cylindrically formed explosive charges and that causes a directed detonation front of increased magnitude over center or single end detonated explosive charges.

SUMMARY OF THE INVENTION

A feature of the invention is to provide a dual-end initiation system having an extreme degree of simultaneity of function that permits the transfer of the explosive output of an ignitor from a single point located in the center of the warhead to its ends without destroying or damaging the warhead. The dual initiation at either end of the explosive provides a directed detonated front of great force radially outward from the center of the warhead, increasing its destructive force.

Figure 1:
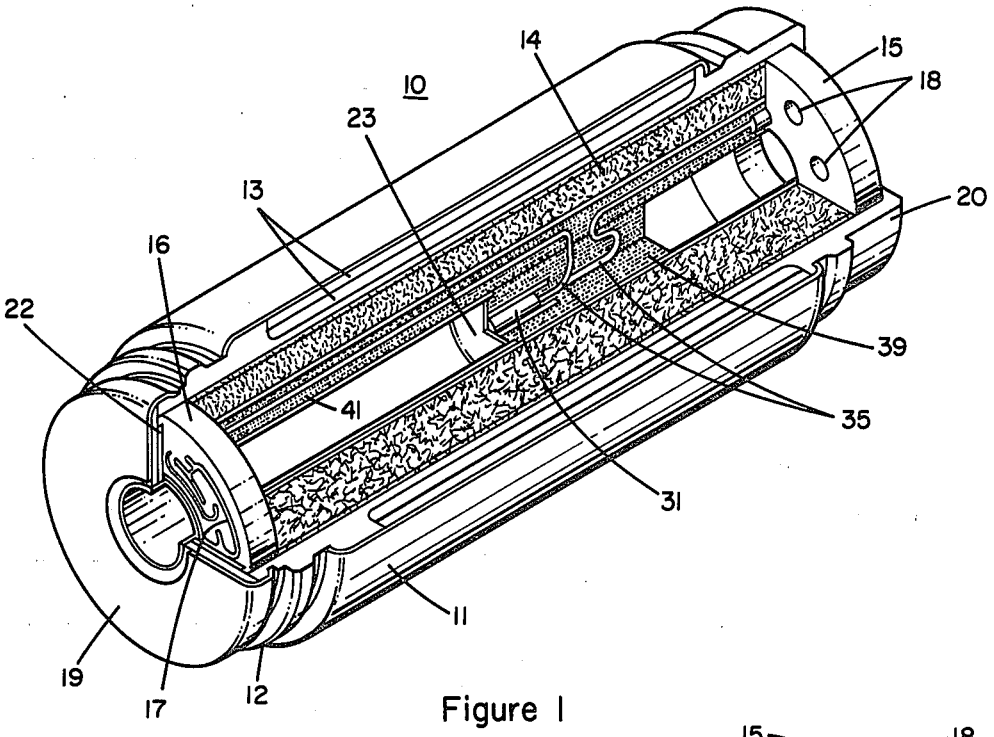
FIG. 1 is a perspective view of the assembled warhead partly in cross section showing the position of the dual-end initiation system.
Figure 2:
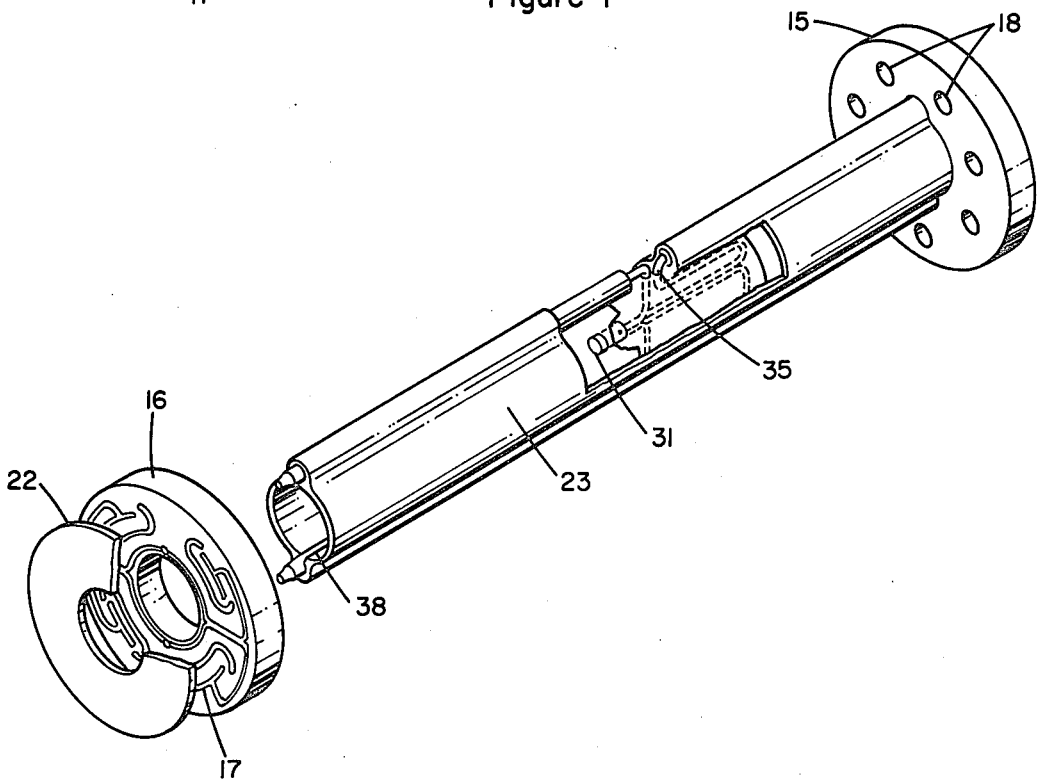
FIG. 2 is an exploded view of the initiation transfer tube assembly with the explosive booster plates in position.
Figure 3:
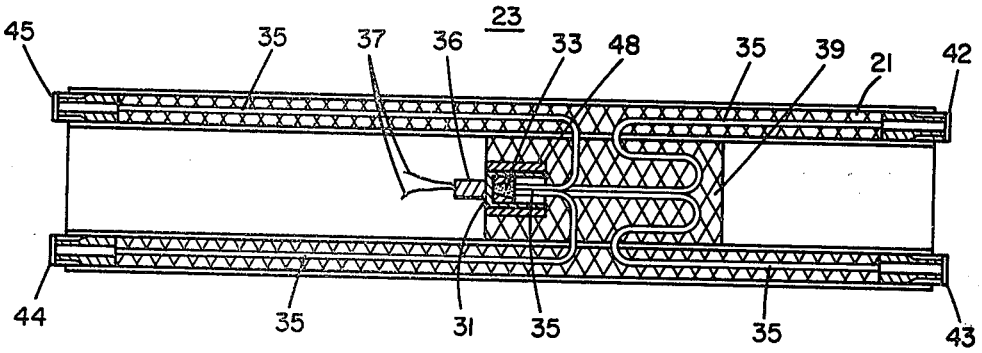
FIG. 3 is a cross sectional view of the initiation transfer tube with the ignitors and explosive train.

Referring now to the drawings, more particularly to FIGS. 1 and 3, the warhead initiation device of this invention is generally indicated by numeral 10 that illustrates a warhead assembly of the type generally utilized in a missile or projectile.

Warhead assembly 10 is made up of six major components, a main body 20, a hollow cylinder of explosive 14, a segmented metal liner 13, a transfer tube assembly

23, two booster plates 15, 16 and end cap 19. The entire assembly of components is incased in a metallic skin 11 constructed from steel to form a warhead that is cylindrical in contour with a length substantially greater than its major diameter. A preformed hollow cylinder of explosive 14 with a centrally bored out portion along its longitudinal axis is positioned inside liner 13. Explosive 14 forms the main explosive charge for warhead 10.

Figure 5:
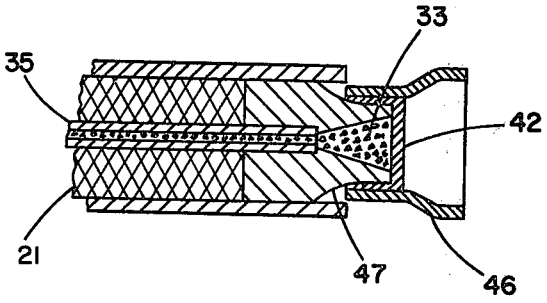
FIG. 5 is a cross sectional view of an end of the transfer tube assembly positioned adjacent the booster plate.
Figure 6:
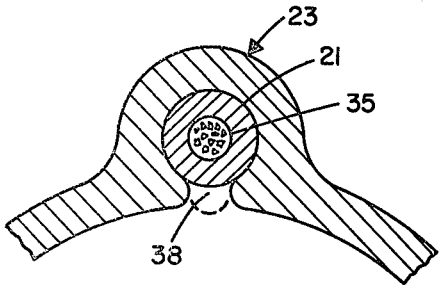
FIG. 6 is a cross sectional view of a portion of the wall of the initiation transfer tube assembly.

Initiation transfer tube assembly 23 constructed of aluminum or like material is fabricated by an extrusion process in the form of a relatively thin walled cylinder that has portions of its wall formed into transfer tube housings that extend along the longitudinal axis of tube assembly 23. The housing, best shown with reference to FIG. 6, is formed so as to have its inner wall compressing shock absorbing material 21 against explosive cord 35. During fabrication, tube 23 is formed in a manner that allows an open portion defining a slot 38 to extend along two dimetrical opposite sides of the housing. This structure facilitates assembly of cord 35 and shock absorbing material 21 within transfer tube 23 since cords 35 can be exteriorly formed and positioned within tube 23 by sliding them in place. At each opening metal ferrules 42, 43, 44 and 45 are swaged onto each end of cords 35. Details of the end structure of each cord end are shown with reference to FIG. 5. A Silastic end piece 46 formed to have one end snugly fitted over the exterior of cap 42 has sufficient length to extend across the airgap between cap 42 and the booster plates. Each of the cords has an end portion 47 that is internally formed to contain a conical powder charge 33 positioned with its apex in contact with the powder within cord 35 and its base adjacent metal ferrule 42.

Positioned centrally within transfer tube assembly 23, best shown with reference to FIG. 3, is an electrically initiated detonator 36 connected to electrical leads 37. This detonator may be any of a number of safe-arm fuzing devices known to those skilled in the art. A plug of shock absorbing material 39 holds primary initiator assembly 31 and the ends of cords 35 rigidly in place. Shock absorbing material 39 performs the same function as shock absorbing material 21. Primary initiator 31 is shown positioned centrally within tube assembly 23 and equidistant from either of its ends but it may be positioned at any location within tube 23 if cords 35 are of equal length.

Figure 4:
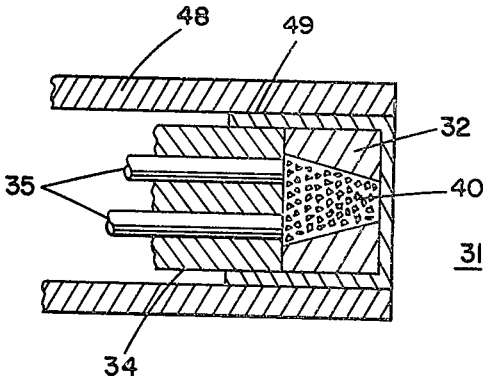
FIG. 4 is a cross sectional view of the primary ignitor.

Primary initiator 31, best shown with reference to FIG. 4, has a cylindrical steel housing 32 with its interior formed in a conical receptacle containing powder 40. Each cord 35 is in intimate contact with powder 40 at the major diameter of the conical receptacle and held in position by means of a metallic element 34. A metallic cap 49 is compressed against element 34 at its open end to rigidly hold steel housing 32 and element 34 together. Positioned over initiator 31 is a cylindrical steel sleeve 48 that has a substantial wall thickness and extends a sufficient length to effectively cover the interface between explosive powder 40 and cords 35. This provides protection for warhead explosive 14 from possible damage by fragments from initiator assembly 31 or shock prior to its detonation from end boosters 15 and 16. Any fragments caused by detonation of explosive powder 40 or detonator 36 are directed from the area along the longitudinal axis of the warhead into the plug of shock insulating material 39.

Each cord 35 is of equal length and extends from primary initator 31 at one end to their respective ferrule elements at its other end. Each cord 35 is completely surrounded by shock absorbing material 39 which completely separates the looped portions of each cord from each other in order to prevent premature damage or crossover explosive paths.

Transfer tube assembly 23 is positioned within warhead explosive 14 and held in position by two booster plates 15 and 16. Each booster plate has a centrally cut out portion that conforms with the exterior wall shape of tube assembly 23 so that each ferrule extends into a recess in each booster plate. This positions each ferrule in correct alignment with the input to the booster end plate channel pattern that is formed in sinuous paths to terminate at each booster charge pellet 18. The path 17 machined or molded in each booster plate are exactly the same length from input to booster pellet and are filled with an explosive for forming a detonation path to initiate each booster charge pellet. Between the end of each ferrule 42, 43, 44 and 45 and booster charge pellet is an air gap. This air gap may be a few thousands of an inch in length in order to prevent damage to the ferrules during shock or vibration at the warhead. The air gap of each end is equalized by means of Silastic member 46 which deforms slightly to maintain an equal airgap between each ferrule and its respective booster plate.

Charge pads, such as pad 22, are positioned between each booster plate and the end cap 19 to protect channel path 17 and form a compression means to keep each booster plate in intimate contact with the warhead explosive 14. Cup shaped metal end cap 19 is fabricated on one end to have its wall portion adjacent the open end conforming with rigde like portions 12 formed in main body 20.

In operation, an electrically initiated current from a source of voltage, not shown, is conducted by means of leads 37 to detonator 36. Detonation causes ignition of powder charge 40 that is conically shaped to cause the detonation front to arrive at the face of each cord 35 at the same instant for causing detonation of each cord to begin simultaneously. Because of the shape of powder charge 40 it is initiated only by particles striking the center portion of assembly 31 and any other particles which strike outside this central area will not effect initiation. The steel sleeve 48 of substantial strength and wall thickness surrounding the ends of cords 35 give a gun barrel effect for directing the detonation product gases and metal fragments from explosive powder 40 along the longitudinal axis of the warhead and into the plug of shock insulating material 39. This prevents premature ignition or damage of explosive powder 14 since radial particle direction is restricted.

Each cord propagates a detonation along its length and since all cords are of equal length the detonating front arrives at each ferrule substantially simultaneously. The use of two cords for each booster plate increases reliability through a redundancy of function since either cord output will properly initiate its booster plate input. An additional factor is that the first cord to function at each end can initiate its booster plate independently thereby reducing the end to end time differential which could occur due to time difference in propagation along each individual cord. As each detonating front travels through the housing formed in transfer tube assembly 23 walls, particles and shock waves emanating from cord 35 are attenuated by shock absorbing material 21 and expansion of the shock absorbing material to the dotted line position in FIG. 6 is allowed by opening of slot 38.

Each ferrule simultaneously projects fragments across the airgaps of equal size to detonate the input portion of channel paths 17 causing continuation of detonating fronts to booster pellet charges 18. Each path length from the input to booster pellet is the same length in order to cause simultaneous initiation of all the booster pellets. These charges detonate each end face of main warhead explosive 14 causing detonating wave fronts to travel along the longitudinal axis of the explosive 14 to meet in a plane normal to the longitudinal axis and equidistant from either end. Directing the two opposite travelling detonating fronts to meet at the center of explosive warhead causes a great force to extend radially outward to create a large concentrated force that has more destructive effect than centrally detonated warheads.

Although the preferred embodiment has been described, it will be understood that within the purview of this invention various charges may be made in the form, details, proportion and arrangement of parts, the combination thereof and mode of operation, which generally stated consist in a device capable of carrying out the functions set forth, as disclosed and defined in the appended claims.

We claim:

1. An initiation apparatus for use in explosive warhead for causing substantially simultaneous initiation at the plurality of predetermined zones of the explosive warhead comprising;

an explosive charge positioned with a chamber;

said explosive charge being formed as a body having a substantial wall thickness and a cavity extending therethrough;

a centrally located initiation transfer means within said explosive charge and having primary and secondary ignitors;

said initiation transfer means being a cylindrical substantially thin walled metal angular container having an expandable detonator train housing formed to extend along the longitudinal axis of said container;

first shock absorbing means located centrally within said annular container and positioned substantially from either end of said annular container;

second shock absorbing means positioned within said detonator train housing;

a multiplicity of detonator trains of equal length interconnecting said primary and secondary ignitors;

booster explosive means positioned adjacent said secondary ignitor and said explosive charge; and actuator means positioned adjacent said primary ignitor for ignition of said primary ignitor;

whereby the actuator means ignites the primary charge thereby causing detonating fronts to travel through the detonator trains to cause detonating of the secondary ignitors which in turn causes the booster explosive to initiate the explosive charge.

2. The initiation housing of claim 1 wherein said first shock absorbing means is a shock absorbing material that surrounds said primary ignitor.

3. The initiation housing of claim 2 wherein said primary ignitor has a cup shaped metal housing;

a metal insert with a conical shaped cavity positioned within said housing;

explosive charge within said cavity.

4. The initiation apparatus of claim 1 wherein said secondary ignitors have an elastic cup like member positioned over each of their ends for providing equal airgaps between said secondary ignitors and said booster explosive means.

* * * * *